United States Patent [19]

Bisbing

[11] Patent Number: 4,470,624

[45] Date of Patent: Sep. 11, 1984

[54] TOOL OPERATED FLUSH SLAM LATCH

[75] Inventor: Robert H. Bisbing, Springfield, Pa.

[73] Assignee: Southco, Inc., Concordville, Pa.

[21] Appl. No.: 383,571

[22] Filed: Jun. 1, 1982

[51] Int. Cl.[3] ..... E05C 1/16

[52] U.S. Cl. ..... 292/169; 292/DIG. 38; 292/337

[58] Field of Search ... 292/175, DIG. 38, 169–169.23, 292/337, DIG. 53

[56] References Cited

U.S. PATENT DOCUMENTS

| | | | |
|---|---|---|---|
| 192,343 | 6/1877 | Niles | 292/169 R |
| 699,223 | 5/1902 | Neher | 292/169.15 |
| 1,137,828 | 5/1915 | Anderson | 292/175 |
| 1,245,617 | 11/1917 | Prinzler | 292/341.18 |
| 2,223,186 | 11/1940 | Rightmyer | 292/169 R |
| 2,840,407 | 6/1958 | Sellon, Jr. | 292/169 R |
| 3,266,830 | 8/1966 | Appleberry | 292/128 |
| 3,472,545 | 10/1969 | Berkowitz | 292/111 |
| 3,841,674 | 10/1974 | Bisbing et al. | 292/175 |

FOREIGN PATENT DOCUMENTS

| | | | |
|---|---|---|---|
| 1425897 | 2/1976 | United Kingdom | 292/169 |

*Primary Examiner*—Richard E. Moore
*Attorney, Agent, or Firm*—Paul & Paul

[57] ABSTRACT

A tool-operated flush-mounted slam latch for a hinged door or panel comprises a slide, a cover, a cam connected to the cover, and a biasing spring for urging the slide forwardly toward a latching position. The slide is retracted to door-opening position by using a tool to operate the cam. The latch is quickly installed in a rectangular hole pre-punched in the door without use of any fastening means by merely pulling the slide rearwardly to a retracted position which is rearwardly beyond that to which the tool-operated cam is capable of retracting the slide. When installed, the cover of the latch is substantially flush with the outer surface of the door.

6 Claims, 9 Drawing Figures

TOOL OPERATED FLUSH SLAM LATCH

BACKGROUND OF THE INVENTION

This invention relates to door latches and in particular to door latches of the slam type, i.e., to latches which will operate to latch the door by merely slamming the door to the closed position.

The invention also relates to slam latches of the flush-mounted type which are quickly installed, without fastening means and without the use of tools, by merely inserting the latch into a rectangular hole pre-cut in the door, with the outer surface of the latch substantially flush with the outer surface of the door.

Pertinent prior art patents known to applicant are (1) U.S. Pat. No. 3,266,830 issued to Walter T. Appleberry on Aug. 16, 1966 and assigned to Douglas Aircraft Company, Inc., and (2) U.S. Pat. No. 3,841,674 issued to Robert H. Bisbing et al on Oct. 15, 1974 and assigned to Southco, Inc., the assignee of the present application.

SUMMARY OF THE INVENTION

A principal object of the present invention is to provide a door latch of the slam type which may be quickly installed in a door or panel without the use of fastening means or tools in a rectangular hole pre-punched in the door with the outer surface of the latch substantially flush with the outer surface of the door.

Another object is to provide a slam latch of the foregoing type which is opened by using a tool inserted into a socket in the latch.

Another object is to provide a slam latch of the foregoing type which is adapted for installation in doors or frames of varying thicknesses.

The foregoing objects are achieved in accordance with the present invention by providing a latch having a slide which, during installation of the latch in a pre-punched rectangular hole in the door, is retracted through a distance which is greater than the distance through which the slide is retracted by the tool when used to open the closed door, thereby preventing the latch from being dislodged from its installed position in the door.

BRIEF DESCRIPTION OF THE DRAWINGS

(In FIG. 3 the door has been omitted).

DETAILED DESCRIPTION OF THE PREFERRED EMBODIMENT

Figure 1:
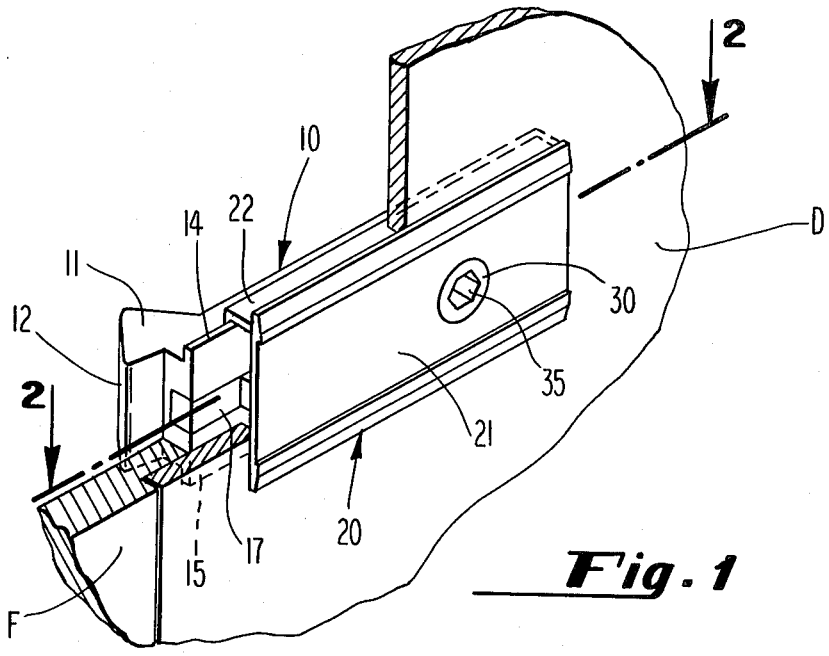
FIG. 1 is a perspective view, partly broken away, showing the tool-operated flush-mounted slam latch of the present invention installed in a door which is shown in closed position in a frame.

In FIG. 1, the tool-operated flush-mounted slam latch is shown installed in a door D which is shown in closed position in a frame F. The latch comprises essentially a slide 10 and a cover 20 the outer surface of which is substantially flush with the outside surface of the door. Slide 10 has a nose portion 11 having a sloping surface 12 which functions to cam the slide 10 rearwardly against the action of a biasing spring 41 during the slamming of the door to closed position. The slide has upper and lower flanges 14,15 which are adapted to slide in upper and lower channels 22,23 of the cover 20.

Figure 2:
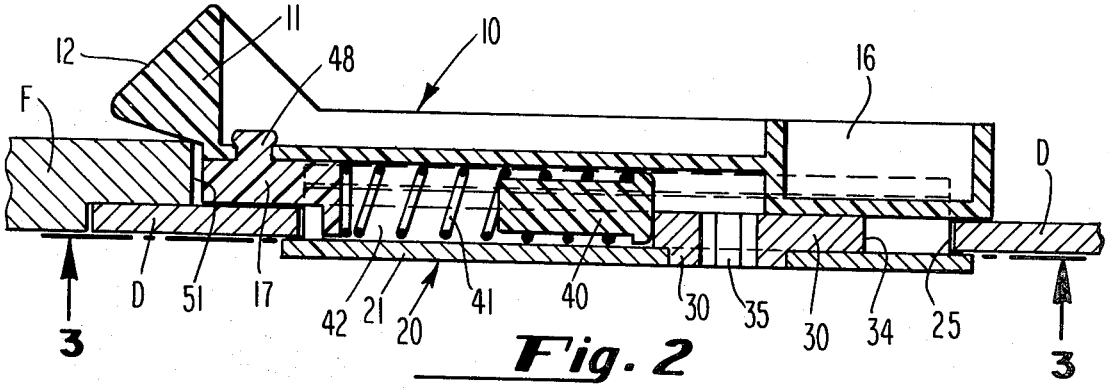
FIG. 2 is a view, in section, looking down along the line 2—2 of FIG. 1.

In FIG. 1, the door D is opened by inserting an Allen wrench in the socket 35 and rotating it through about 45 degrees in either the clockwise or counterclockwise direction. This retracts slide 10 sufficiently to allow the nose 11 to clear the edge 51 of the frame F and allows the door D to open. After opening, the Allen wrench is removed from the socket 35 and the slide 10, which is spring loaded by compression spring 41, as seen in FIGS. 2-4, returns to its forward or latching position.

To close the door, it is merely slammed shut. During closing, the sloping edge 12 of nose 11 of slide 10 comes into engagement with edge 51 of frame F and slide 10 is cammed rearwardly to a retracted position.

Figure 3:
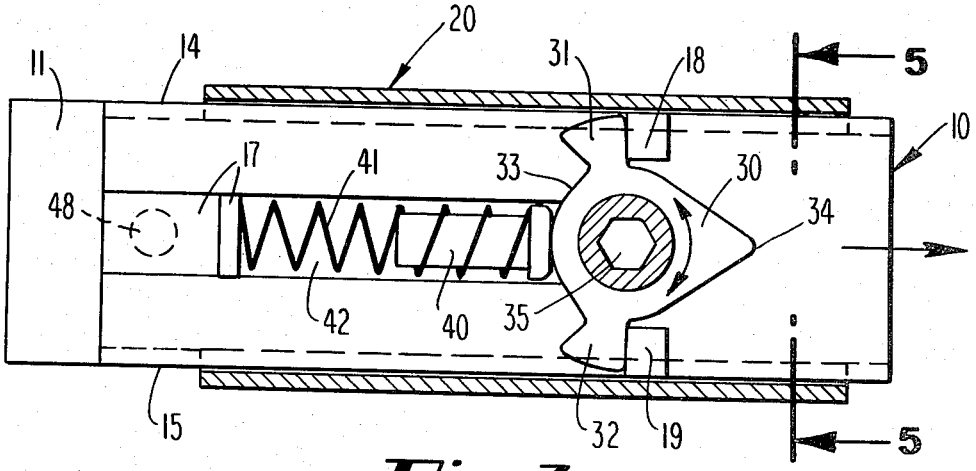
FIG. 3 is a view looking along the line 3—3 of FIG. 2.
Figure 4:
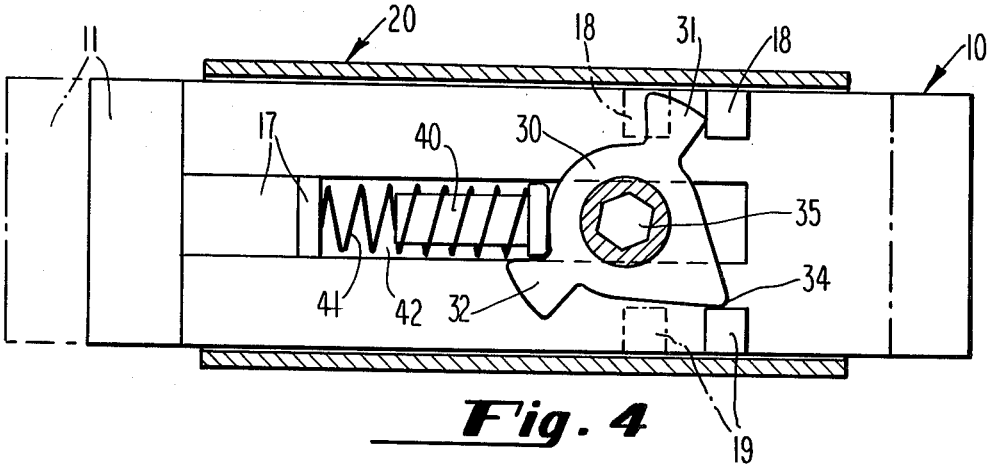
FIG. 4 is a view generally similar to FIG. 3 but showing the position of the slide in the door-opened position after the tool has been used to rotate the cam to retract the slide.
Figure 5:
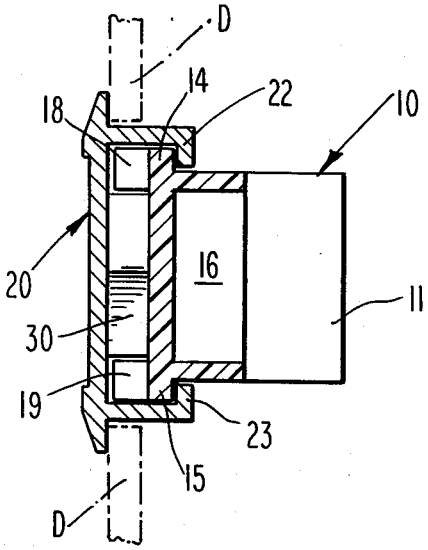
FIG. 5 is a view, in section, looking along the line 5—5 of FIG. 3.

As seen best in FIGS. 3-4, mounted on, or integral with, socket 35 is a cam 30 having upper and lower ears 31,32. Between ears 31,32, on the forward side of the cam, is a curved surface 33. On the rearward side, between ears 31,32 cam 30 is wedge-shaped, narrowing to a tip 34, which is preferably a rounded edge of small radius. Positioned against the rear edge of each of the ears 31,32 is a tab 18,19, respectively. These tabs 18,19 are connected to, or integral with, slide 10.

Bearing against the curved central portion of the forward surface 33 of cam 30 is the head of a pin 40 which supports one end of a coil compression spring 41. Compression spring 41 is located in a slot 42 in slide 10. At its forward end, spring 41 presses against a retainer 17 which has a pin portion 48 which projects into a hole in slide 10. Thus, retainer 17 is connected to and is movable with slide 10. The working end of spring 41 is the left end, as viewed in FIGS. 2-4, which bears against retainer 17. The other end of spring 41 is merely retained by surface 33 of cam 30.

FIG. 4 illustrates the condition of the latch after the Allen wrench has been inserted into socket 35 and turned clockwise through about 45 degrees. It will be seen that when this is done, upper ear 31 pushes against tab 18 and moves tab 18 rearwardly, thereby moving slide 10 rearwardly. This rearward movement of slide 10 continues until the rounded tip 34 of cam 30 comes into engagement with the inner surface of the lower tab 19 which has now been moved from the position shown in phantom to the position shown in solid line. This is the rearmost limit position of the slide 10 when operated by the cam. In this position, nose 11 of slide 10 will clear edge 51 of frame F, allowing the door to open. In the condition shown in FIG. 4, which is the limit position of the cam in the door-opening position, compression spring 41 has been compressed. Thus, after the door has been open, when the socket wrench is removed from socket 35, the forward end of the spring 41 forces retainer 17 and slide 10 in the forward direction, thereby pulling tab 18 to the left as viewed in FIGS. 3-4, thereby returning cam 30 to the position shown in FIG. 3.

In this position, nose 11 of slide 10 is in the forward or latching position, and as previously described, when the door is slammed to the closed position, the sloping edge 12 of nose 11 engages the edge 51 of the frame F, thereby camming slide 10 rearwardly. As soon as the nose 11 clears the frame F, the slide 10 is returned to its forward latching position by spring 41.

Figure 6:
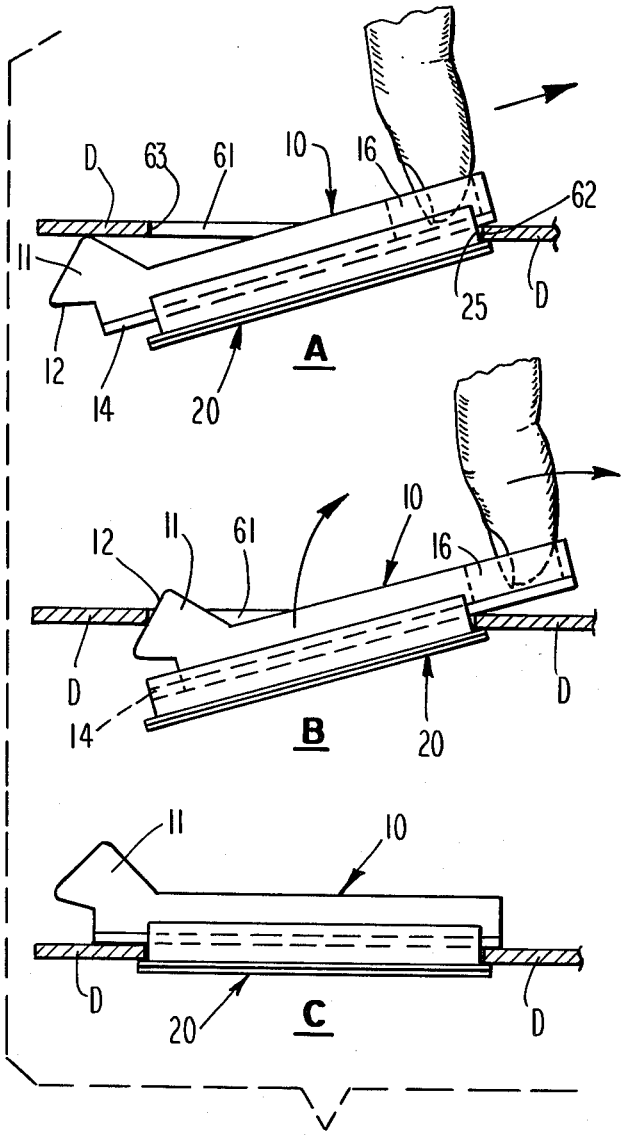
FIGS. 6A, 6B and 6C in a series of illustrations showing the sequence of steps by which the slam latch is inserted into the rectangular pre-punched hole in the door.

The manner in which the tool-operated flush-mounted slam latch is installed in the hinged door D is illustrated in FIGS. 6A, 6B and 6C. The door D is provided with a rectangular pre-cut hole 61 having a rearward edge 62 and a forward edge 63. The installer places the notch 25, located at the rearward end of the latch, against the rear edge 62 of door D. The finger of the installer is placed in notch 16 of slide 10. This notch 16 is clearly shown in FIG. 2. Using his finger, the installer pulls slide 10 rearwardly. This allows nose 11 of slide 10 to enter hole 61 and to move upwardly past the forward edge 63 of the hole 61, as shown in FIG. 6B. As a result, the latch snaps into its final installed position, shown in FIG. 6C. Once installed, the latch is not removable by use of the socket wrench since the distance through which slide 10 is moved by means of the cam 30 is less than the distance through which slide 10 is moved by means of the finger notch 16. The length of the pin 40 is made short enough to allow spring 41 to be compressed sufficiently to allow nose 11 of slide 10, when pulled rearwardly by the finger, to clear the forward edge 63 of the hole 61. This compression of spring 41 is greater than that illustrated in FIG. 4 which shows the slide 10 retracted to maximum extent, when retraction is by the cam 30, actuated by the socket wrench.

Figure 7:
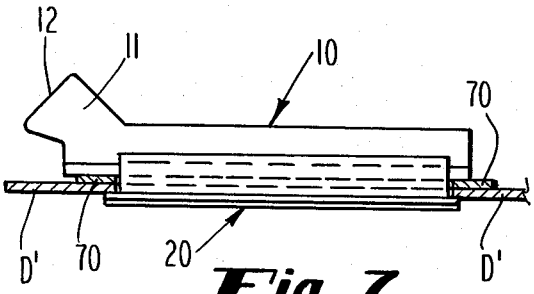
FIG. 7 is a view similar to FIG. 6C but showing the use of a shim when the slam latch is inserted in a door made of thinner material.

The tool-operated flush-mounted slam latch of the present invention may be installed in doors of various thicknesses. FIG. 7 illustrated the latch installed in a door D′ made of thinner material. A rectangular shim 70 of suitable thickness is positioned about the perimeter of the pre-cut hole in the door, so that when the latch is installed, it is tight and firm and rattle-free.

What is claimed is:

1. A tool-operated flush-mounted slam latch for latching a door to a frame, said latch being adapted to be installed manually without use of tools in a slot pre-cut in said door, said latch comprising:

a. a slide having a door-latching nose at its forward end;

b. a cover for said slide;

c. a finger-notch at the rearward end of said slide for manually withdrawing said slide to a sufficiently rearward position to allow insertion of said slide into said pre-cut door slot during installation of said latch;

d. a cam secured to said cover for rotational movement relative to said cover;

e. means biasing said slide to a forward door-latching position;

f. tab members projecting from said slide, one on each side of said cam;

g. ears on each side of said cam, one ear abutting against each of said tab members when said slide is in said biased door-latching position; and h. means connectible to said cam for rotating said cam, rotation of said cam causing one of said ears to push one of said tab members rearwardly to move said slide to a withdrawn door-opening position and causing the other of said tab members to move to a stop position to limit further rotation of said cam, thereby to limit the withdrawal movement of said slide to a position short of that necessary for insertion of said slide in said door slot during installation of said latch.

2. A latch according to claim 1 wherein said biasing means comprises:

a. retaining means connected to said slide;

b. a compression spring having its forward end retained by said retaining means and its rearward end retained by means connected to said cover.

3. A latch according to claim 2 wherein the rearward end of said spring is retained by a forward surface of said cam.

4. A latch according to claim 3 wherein the rearward surface of said cam between said ears is wedge-shape having a rounded edge of small radius at its tip, said tip, when the cam is rotated, being adapted to come into engagement with an inner surface of the other of said tab members at said stop position, thereby to limit the rotational movement of said cam.

5. A latch according to claim 4 wherein said means connectible to said cam for rotating said cam comprises:

a. a socket in said cam on the center axis thereof, said socket extending through a hole in said cover; and b. key means insertible in said socket.

6. A latch according to claim 5 wherein said slide is provided with upper and lower flanges, and said cover is provided with upper and lower channels for receiving said flanges for sliding movement therein.

* * * * *